US005705470A

United States Patent [19]

Faris

[11] Patent Number: 5,705,470

[45] Date of Patent: Jan. 6, 1998

[54] SPRAYABLE CLEANING GEL, DISPENSER, AND METHOD OF USING SAME

[75] Inventor: Theodore P. Faris, 3689 Darcy Dr., Bloomfield Hills, Mich. 48301

[73] Assignees: Edward F. Topa; Theodore P. Faris, both of Bloomfield Hills, Mich.; Peter D. Keefe, Roseville, Mich.

[21] Appl. No.: 573,461

[22] Filed: Dec. 15, 1995

[51] Int. Cl.[6] ..... C11D 3/37; C11D 3/43; B08B 7/00

[52] U.S. Cl. ..... 510/403; 510/108; 510/182; 510/238; 510/406; 510/432; 510/434; 510/476; 510/477; 510/506; 134/40; 134/42

[58] Field of Search ..... 510/403, 406, 510/238, 434, 432, 476, 477, 506, 279, 180, 181, 182, 108; 134/40, 42

[56] References Cited

U.S. PATENT DOCUMENTS

| | | | |
|---|---|---|---|
| 2,220,099 | 11/1940 | Guenther et al. | 260/505 |
| 2,477,383 | 7/1949 | Lewis | 252/161 |
| 3,669,892 | 6/1972 | Abler et al. | 510/406 |
| 3,929,678 | 12/1975 | Laughlin et al. | 252/526 |
| 4,077,896 | 3/1978 | Bunegar et al. | 510/406 |
| 4,551,481 | 11/1985 | Smith et al. | 521/52 |
| 4,587,030 | 5/1986 | Casey | 510/406 |
| 4,810,407 | 3/1989 | Sandvick | 510/406 |
| 4,836,948 | 6/1989 | Corring | 510/403 |
| 4,867,896 | 9/1989 | Elliott et al. | 510/223 |
| 4,971,631 | 11/1990 | Sallee et al. | 134/3 |
| 5,047,167 | 9/1991 | Steyn et al. | 510/403 |
| 5,057,152 | 10/1991 | Marcus et al. | 106/3 |
| 5,141,664 | 8/1992 | Corring et al. | 252/90 |
| 5,160,448 | 11/1992 | Corring | 510/403 |
| 5,192,460 | 3/1993 | Thomas et al. | 510/406 |
| 5,340,570 | 8/1994 | Wong et al. | 434/71 |
| 5,393,453 | 2/1995 | Mondin et al. | 510/365 |
| 5,409,630 | 4/1995 | Lysy et al. | 510/401 |
| 5,462,689 | 10/1995 | Choy et al. | 510/406 |
| 5,534,200 | 7/1996 | Erilli et al. | 510/403 |
| 5,545,354 | 8/1996 | Ofosu-Asante | 510/403 |

OTHER PUBLICATIONS

Research Disclosure 382042, No. 382 Feb. 1996.

Clorox Clean–Up gel cleaner with bleach product advertisement of The Clorox Co., El Paso TX 88588, *Detroit free Press*, Aug. 12, 1995.

Lysol Cling thick liquid toilet bowl cleaner product advertisement of Reckitt & Colman, Del Rio, TX 78840, *Detroit Free Press*, Oct. 1, 1995.

Soft Scrub liquid gel with bleach cleaner product advertisement of The Clorox Co., El Paso TX 88588, *Detroit Free Press*, Oct. 1, 1995.

Eccolube RT–5–8 Technical Bulletin and Material Safety Data Sheet of Eastern Color & Chemical Co., Providence, RI 02904, dated Mar. 28, 1994.

Eccostat 501 Technical Bulletin and Material Safety Data Sheet of Eastern Color & Chemical Co., Providence, RI 02904, date unknown.

Carbopol product bulletin DET–300 for hard surface sprayable cleaner of 200cP, B.F. Goodrich Specialty Chemicals, Cleveland, OH 44141, dated Jun. 1995 or Apr. 1995.

Carbopol product bulletin TDS–209 for sprayable cleaner of 90cP, B.F. Goodrich Specialty Chemicals, Cleveland, OH 44141, dated Mar., 1994, copyright 1993.

(List continued on next page.)

*Primary Examiner*—Paul Lieberman
*Assistant Examiner*—Lorna M. Douyon
*Attorney, Agent, or Firm*—Peter D. Keefe; William D. Blackman

[57] ABSTRACT

A substantially homogeneous sprayable cleaning gel composition which is substantially free of suspended encapsulated particles exhibits extended dwell time when sprayed on to a surface as compared to a low viscosity spray cleaner. The extended dwell time and anti-static properties of the sprayable cleaning gel composition give rise to several benefits and advantages. The sprayable cleaning gel composition housed in a spray applicator is usable to clean surfaces at any angle. A preferred method of cleaning surfaces is also described.

9 Claims, 1 Drawing Sheet

OTHER PUBLICATIONS

Formulation Ideas in *Soap/Cosmetics/Chemical Specialties*, Sep. 1995, p. 127.

Carbopol (registered TM) product use bulletin for thickening organic acids, B.F. Goodrich Specialty Chemicals, Cleveland, OH 44141, date unknown.

Carbopol (registered TM) product bulletin TDS#203 for EZ–1 polymer, B.F. Goodrich Specialty Chemicals, Cleveland, OH 44141, 3 pages dated Sep. 1994.

Carbopol (registered TM) product bulletins F001 through F0010 for various polishes, B.F. Goodrich Specialty Chemicals, Cleveland, OH 44141, dated Sep. 1994.

Carbopol (registered TM) product bulletin PS–101 for powdered resins, B.F. Goodrich Specialty Chemicals, Cleveland, OH 44141, dated Nov. 1994.

Buro Thix PCS product bulletin for thickener for FB–sodium percarbonate, Burlington Chemical Co., Inc., Burlington, NC 27216, dated 1987.

Antifog Window Cleaner product bulletin, Burlington Chemical Co., Inc., Burlington, NC 27216, dated 1987.

Formulary reference guide of Exxon Chemical Co., Tomah Products, Inc., Milton, WI 53563, data sheet P–5 describing vehicle cleaners, dated Aug. 1986.

Glass Cleaner Formulas G–100, G–101, G–102 of Tomah Products, Inc., Milton, WI 53563, date unknown.

Fact Sheet of Viscous Cleaners Formula A–104 and A–107 of Tomah Products, Inc., Milton, WI 53563, date unknown.

Neodol Formulary for window/glass cleaners of Shell Chemical Co., Anaheim, CA 92803, dated Mar. 1988.

Hard Surface Cleaners fact sheet of hard surface cleaners 25 through 28, of The Dow Chemical Co., Midland, MI 48674, dated May, 1991.

All–Purpose Cleansers fact sheet of all–purpose cleaners 8 through 11, of The Dow Chemical Co., Midland, MI 48674, dated May, 1991.

Glass Cleaners fact sheet of all–purpose cleaners 1 through 4, of The Dow Chemical Co., Midland, MI 48674, dated May, 1991.

Sanitary Chemicals Manual, p. 56, of Rohm and Haas Co., Philadelphia, PA 19106, dated Aug. 1978.

SPRAYABLE CLEANING GEL, DISPENSER, AND METHOD OF USING SAME

CROSS REFERENCE TO REFERENCE APPLICATIONS

The present application is a continuation-in-part application of co-pending application Ser. No. 08/491,156, filed on Jun. 16, 1995, now provisional application Ser. No. 60/011,755.

BACKGROUND OF THE INVENTION

1. Field of the Invention

The present invention relates to a sprayable cleaning gel composition, which is preferably packaged in a spray applicator, and to a method of cleaning using the composition and spray applicator hereof. More particularly, the present invention relates to a substantially homogeneous sprayable cleaning gel composition which clings to and dwells on a cleanable surface when sprayed thereon. Preferably, the sprayable cleaning gel composition hereof is housed in a spray applicator for convenient application thereof. The present invention also relates to a method of cleaning a surface, using the sprayable cleaning gel composition and spray applicator hereof.

2. Description of the Related Art

Several low viscosity sprayable cleaning compositions such as glass cleaners, all-purpose cleaners, and bathroom cleaners are known and used in many households today. Generally, these commercially available spray cleaners have a viscosity in a range from about 3 centipoise (cP) to about 10 cP. Accordingly, these known spray cleaners are somewhat 'watery' in consistency and have a tendency to run off of surfaces that they are applied to, particularly if those surfaces are vertically oriented, as most windows are. This 'run-off' leads to waste and inefficiency, and tends to wet non-target areas in application of the cleaner. Further, if one of these currently available spray cleaners is sprayed onto a flattened undersurface of a cabinet or the like, the currently available cleaner tends to drip off of that surface rather than to cling thereto.

A discussion of some known cleaning foams and gels follows.

Sprayable foaming cleaning compositions are known and are commercially available today. Foaming glass and surface cleaners do exhibit some short-lived tendency to cling to a surface when sprayed thereon and to dwell on the surface for a short time. However, foams do sag and run fairly quickly. Also, foams contain at least 15 to 30 percent air, which results in incomplete product to surface contact during dwell time, and in reduced cleaning effectiveness as compared to a product which exhibits more product to surface contact.

A cleaning and bleaching gel has recently come on to the market, sold by the CLOROX Company under the name "CLOROX Clean-up Gel". No spray applicator is advertised for use with this product, and the bleach component of the product is emphasized in the advertisements. This product contains a significant quantity of bleach and the label warns not to use it on clothes, fabric, carpet, wood, and painted surfaces, and further warns that prolonged contact with metal, old porcelain or plastic laminate countertops may cause discoloration. Applications available for this bleaching product, because of the manufacturer's warnings and limitations, are necessarily somewhat limited.

Products known generally as 'naval jelly', which are applied with a brush, are known and used for cleaning rust off of metals such as steel. However, these products are caustic to exposed skin, give off hazardous fumes, may be flammable, and are not suitable for cleaning household surfaces. Moreover, naval jelly is made up of entirely different components from those that make up the sprayable cleaning gel composition according to the present invention.

U.S. Pat. No. 5,141,664 to Corring et. al., issued Aug. 25, 1992, discloses a clear detergent gel for use in an automatic dishwasher. The detergent gel of Corring et. al. is not homogeneous, but instead contains dispersed and suspended opaque particles of an active material such as a bleach, the particles of active material being encapsulated in a layer of protective material to prevent them from reacting with the surrounding gel before use.

Many different types of cleaning compositions are available on the market today. However, a need still exists for a sprayable cleaning gel composition which is substantially homogeneous, which is substantially free of suspended encapsulated particles, and which tends to cling to and dwell on a surface when sprayed thereon, for ease and efficiency of use.

B.F. Goodrich Co., Specialty Chemicals, Cleveland, Ohio 44141 has published (March, 1994) a formulation (hereinafter referred to as the "BFG 90 cP Formulation") for a glass and multipurpose cleaner which discloses the following:

| Ingredient | Wt. % (as is) | Function |
|---|---|---|
| DI Water | 80.6 | Diluent |
| Carbopol ETD 2691[1] | 0.2 | Thickener |
| Isopropanol | 15.0 | Solvent/cleaner |
| Dowanol PM[2] | 3.0 | Solvent/cleaner |
| Bioterge PAS-BS[3] | 1.0 | Surfactant |
| Ammonium Hydroxide (28%) | 0.2 | Neutralizer/alkalinity |

Wherein the superscripts are defined as follows:
[1]A registered trademark product of B.F. Goodrich Co.
[2]A registered trademark product of Dow Chemical Co.
[3]A product of Stepan Chemical Co.

Procedure: Disperse Carbopol ETD-2691 into DI water with moderate agitation; combine isopropanol and Dowanol PM and blend with Carbopol resin dispersion; add Bioterge PAS-BS to the mixture; and neutralize with ammonium hydroxide to a pH of 9.5–10.0. Properties: Viscosity equals 90 centipoise (cP); pH (as is) equals 9.5; and appearance is a clear liquid. B.F. Goodrich Company indicates that the following characteristics pertain: cleans glass to a sparking finish; streak-free results; provides vertical cling-doesn't run down; and reduces mist to air.

B.F. Goodrich Co., Specialty Chemicals, Cleveland, Ohio 44141 has published (June, 1995) another formulation (hereafter referred to as the "BFG 200 cP Formulation") for a glass and multipurpose cleaner which discloses the following:

| Ingredient | Wt. % |
|---|---|
| DI Water | 92.45 |
| Carbopol ETD 2623[1] | 0.10 |
| Isopropanol | 5.00 |
| Alkylbenzene Sulfonic Acid (97%)[2] | 0.25 |
| Propylene Glycol Methyl Ether[3] | 2.00 |
| Ammonium Hydroxide | 0.20 |

Wherein the superscripts are defined as follows:
[1]A registered trademark product of B.F. Goodrich Co.
[2]Biosoft S-100, a product of Stepan Chemical Co.
[3]Dowanol PM, a registered trademark product of Dow Chemical Co.

Procedure: Using moderate agitation (800 RPM) provided by a variable speed unit and suitable impeller for mixing and blending operations, dispense or screen the Carbopol resin into the DI water. Mix the slurry for approximately 15 minutes or until homogeneous. Add the isopropanol. Add the ammonium hydroxide and mix until homogenous. Add the sulfonic acid and glycol ether with minimal agitation. Add additional ammonium hydroxide, if necessary, to reach target pH. Add color and fragrance, if desired. Properties: Viscosity equals 200 cP; pH equals 9.5–10; and clarity is clear. The manufacturer offers these comments: "Carbopol resins are used to increase the yield value resulting in vertical cling when sprayed on a vertical surface. This "no-drip" action will increase the contact time of the detergent on the soiled surface as well as enhance consumer convenience."

Applicant has formulated the above recounted "BFG 90 cP Formulation" and "BFG 200 cP Formulation", and thereupon performed spray/cling tests on them. The tests were conducted, at substantially standard temperature and pressure, as follows: each formulation was sprayed once onto a vertical mirror 22 inches long by 18 inches wide from a distance of 4 inches using a model SSA pump sprayer manufactured by Calmar, inc. Of Lee's Summit, Mo. 64081 having a sprayer orifice of 0.025 inches. The following results were obtained.

| Run Distance | Elapsed Time |
|---|---|
| The "BFG 90 cP Formulation": | |
| 4 inches | 4 seconds |
| 6 inches | 10 seconds |
| 12 inches | 52 seconds |
| 22 inches | 202 seconds |
| The "BFG 200 cP Formulation": | |
| 4 inches | 20 seconds |
| 6 inches | 111 seconds |
| 8 inches | 118 seconds |
| 14 inches | 135 seconds (then no running) |

From the foregoing tests, it is clear that each of the B.F. Goodrich "BFG 90 cP Formulation" and "BFG 200 cP Formulation" run along a vertical surface and do not provide substantially motionless surface dwell on a vertical surface. Applicant has ascertained that in order for a sprayable cleaner to have surface dwell, wherein substantially motionless vertical surface cling without running is provided (as will be elaborated by exemplar tests described hereinbelow), a viscosity at least an order of magnitude higher than that of the hereinabove described B.F. Goodrich "BFG 90 cP Formulation" is required (ie., the sprayable cleaner must have a viscosity of at least 900 cP). Consequently, what is needed in the art is to somehow provide a sprayable cleaner having a viscosity of at least 900 cP which is easily sprayable with a spray distribution substantially absent globs on the surface.

SUMMARY OF THE INVENTION

The present invention is a sprayable cleaning gel composition having the surprising and unexpected property of having a very high viscosity (over about 900 cP) and yet is easily sprayable, having an excellent spray distribution on a surface upon which it is sprayed, and further providing an anti-static quality to the surface.

The present invention, in a first embodiment thereof, encompasses a substantially homogeneous sprayable cleaning gel composition which is substantially free of suspended encapsulated particles. Preferably, the sprayable cleaning gel composition according to the present invention is housed in a spray applicator.

A preferred embodiment of the sprayable cleaning gel composition in accordance with the present invention generally comprises (percentages are by weight of the composition): from about 75% to about 98% of a carrier fluid; from about 0.005% to about 20% of a surfactant component comprising at least one surfactant selected from the group consisting of nonionic, anionic, cationic, amphoteric, and zwitterionic surfactants and mixtures of the above; and from about 0.01% to about 10% of a water-soluble polymeric thickening agent; wherein the sprayable cleaning gel composition has a viscosity from about 900 cP to about 5,550 cP, preferably from about 1,500 cP to about 4,500 cP and most preferably from about 2,700 cP to about 3,000 cP.

The preferred embodiment of the sprayable cleaning gel composition in accordance with the present invention preferably further comprises: from about 1% to about 20% of at least one supplemental solvent for dissolving oil-based particles in water; and from about 0.001% to about 5% of a dispersant to promote homogeneous distribution of the mixture components in the composition and to break up and disperse soils in application of the sprayable cleaning gel composition. Preferred supplemental solvents for use in the composition hereof are those selected from the group consisting of ethylene glycol ethers and propylene glycol ethers.

The sprayable cleaning gel composition according to the preferred embodiment hereof may, optionally, include additional adjuvants such as, e.g., a fragrance or a colorant.

The sprayable cleaning gel composition according to the present invention has an innate property of providing a very low level of residual static electric charge which is left on a surface after it has been wiped thereoff. This anti-static property is important in that surface wiping ordinarily tends to generate significant static electric charge on the surface which causes dust to collect thereupon; accordingly, minimization of static electric charge on the cleaned surface is important to providing a long term clean surface. To provide even further and longer lasting minimization of static electric charge on the cleaned surface after wiping, the sprayable cleaning gel further comprises preferably from about 0.05% to about 1.0% of an anti-static agent. In this regard, it has been discovered that a water soluble silicone based lubricant and softener serves as both a surfactant and an unexpectedly excellent anti-static agent.

The present invention also encompasses a spray applicator in combination with the sprayable cleaning gel composition hereof. This combination allows for more efficient cleaning of surfaces than was possible with the prior art cleaners.

The present invention further encompasses a method of cleaning a surface using the sprayable cleaning gel composition and spray applicator hereof. A method in accordance with the present invention, generally, comprises the steps of: 1) spraying a substantially homogeneous sprayable cleaning gel composition onto a surface to be cleaned, the sprayable cleaning gel composition comprising: from about 75% to about 98% of a carrier liquid; from about 0.005% to about 20% of a surfactant selected from the group consisting of nonionic, anionic, cationic, amphoteric, and zwitterionic surfactants and mixtures of the above; optionally from about 0.05% to about 1.0% of an anti-static agent; and from about 0.01% to about 10% of a water-soluble polymeric thickening agent, wherein the sprayable cleaning gel composition has a viscosity from about 900 centipoise (cP) to about 5,550 cP, and wherein the sprayable cleaning gel composition substantially clings to and dwells on the surface rather than running downwardly thereon under the effect of gravity at standard temperature and pressure (25 degrees Centigrade and 1 atmosphere pressure); 2) spreading the sprayable cleaning gel composition around the surface with a wiping article, such as a cloth rag or a paper towel; and 3) wiping the sprayable cleaning gel composition off the surface via the wiping article.

Accordingly, it is an object of the present invention to provide a sprayable cleaning gel composition which will cling to and dwell on a surface to be cleaned longer than the prior art compositions.

It is an additional object of the present invention to provide a sprayable cleaning gel which will provide improved product to surface contact during cleaning.

It is another object of the present invention to provide a sprayable, yet viscous, cleaning gel composition which exhibits a unique physical appearance which is substantially transparent with air bubbles entrained therein.

It is yet another object of the present invention to provide a sprayable cleaning gel composition which includes anti-static properties so that when the sprayable cleaning gel composition is wiped off a surface, static electric charge thereon is significantly minimized.

It is a further object of the present invention to provide a sprayable cleaning gel composition and method of use thereof which will be more efficient and therefore less wasteful in application than currently available spray cleaners.

These, and additional objects, advantages, features and benefits of the present invention will become apparent from the following specification.

DETAILED DESCRIPTION OF THE PREFERRED EMBODIMENT

Figure 1:
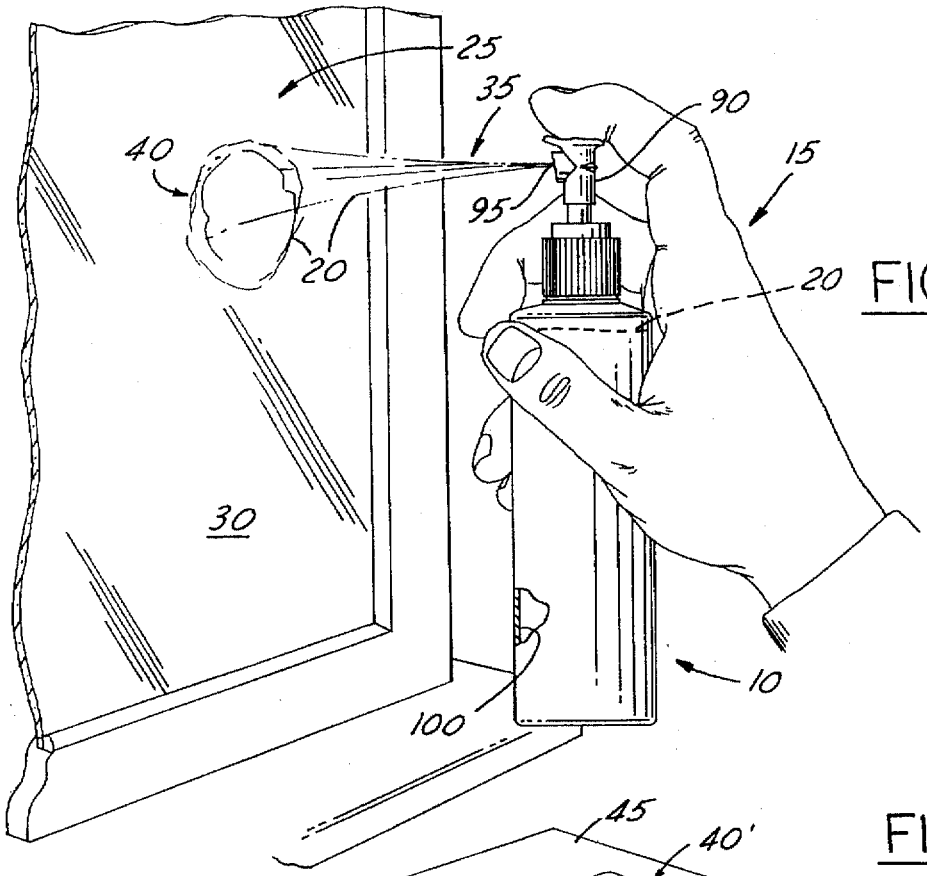
FIG. 1 is a perspective view of a spray applicator applying a sprayable cleaning gel composition to a vertical surface in accordance with the present invention.
Figure 1A:
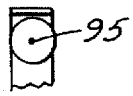
FIG. 1A is a partly broken-away front elevational view of the spray head of the spray applicator of FIG. 1.

Referring now to the drawing, a spray applicator 10 is shown in an operator's hand 15 operating to dispense a sprayable cleaning gel composition 20 according to the present invention from the spray applicator onto a vertical surface 25 which is shown by way of example as a window pane 30. When an operator's hand 15 presses downwardly on a spray head 90, the sprayable cleaning gel composition 20 is atomized by the spray applicator 10 into a spray 35 which adheres to the vertical surface 25 thereby forming a deposit 40 of sprayable cleaning gel composition 20 thereon.

As will be further detailed herein, the sprayable cleaning gel composition 20 is a relatively viscous, substantially homogeneous gelatinous composition which is substantially free of suspended encapsulated particles. The sprayable cleaning gel composition 20 according to the present invention is also, preferably, free from chlorine bleaches in order to avoid any reaction between a reactive hypochlorite bleach and oxidation-sensitive perfumes or surfactants. Another reason that bleaches are, preferably, excluded from the sprayable cleaning gel composition hereof is that the sprayable cleaning gel composition hereof is intended to be suitable for use on virtually all surfaces, including glass, plastics, vinyls, metals, and painted surfaces. Moreover, if a cleaner containing bleach is spilled on clothing, it may burn holes therein or create unsightly spots thereon. In contrast, the sprayable cleaning gel composition according to the present invention will not stain or damage clothing if spilled thereon.

Unless otherwise noted, all component percentages in this discussion are by weight of the sprayable cleaning gel composition.

In a preferred embodiment of the present invention, the sprayable cleaning gel composition 20 comprises: from about 75% to about 98% of a liquid carrier; from about 0.005% to about 20% of a surfactant selected from the group consisting of nonionic, anionic, cationic, amphoteric, and zwitterionic surfactants and mixtures of the above; and from about 0.01% to about 10% of a water-soluble polymeric thickening agent; wherein the sprayable cleaning gel composition has a viscosity from about 900 centipoise (cP) to about 5,550 cP at standard temperature and pressure (25 degrees Centigrade and 1 atmosphere of pressure).

In a further preferred embodiment of the present invention, the sprayable cleaning gel composition hereof further comprises: from about 1% to about 20% of at least one supplemental solvent for dissolving oil-based particles in water; and from about 0.001% to about 5% of a dispersant; wherein the thickening agent is a polyacrylic acid thickener.

In yet a further preferred embodiment of the present invention, the sprayable cleaning gel composition 20 hereof further comprises from about 0.05% to about 0.50% of an anti-static agent.

The sprayable cleaning gel composition according to the preferred embodiments hereof may, optionally, include additional adjuvants such as a fragrance, a base, an organic acid, a chelant such as sodium EDTA, or a colorant.

Components of the Sprayable Cleaning Gel Composition

Liquid Carrier

The sprayable cleaning gel composition according to the present invention includes a liquid carrier as a primary solvent. The carrier fluid may be water, alcohol, or mixtures thereof. Where alcohols are used in the liquid carrier, preferred alcohols include isopropyl alcohol, methanol, tert-butyl alcohol, and mixtures thereof. Water is considered to be a preferred carrier fluid in this formulation. The liquid carrier is present in a range from about 75% to about 98% of the composition, preferably in a range from about 85% to about 98% of the composition, and most preferably in a range from about 90% to about 97% of the composition.

Too much liquid carrier may result in spotting and/or unacceptably low viscosity; and too little liquid carrier could result in filming or in difficulty wiping away the sprayable cleaning gel composition from the surface being cleaned.

Surfactant

In order to boost the cleaning power of the sprayable cleaning gel composition hereof, a surfactant component comprising at least one surfactant is present in the composition hereof in a range from about 0.005% to about 20% of the composition, preferably from about 0.005% to about 15% of the composition, and most preferably from about 0.01% to about 10% of the composition.

Surfactants are generally well-known in the detergent art. Surfactants which are usable in the practice of the present invention include anionic, nonionic, cationic, amphoteric, zwitterionic, and mixtures of the above types.

1. Anionic Surfactants:

Anionic synthetic detergents can be broadly described as surface active agents with one or more negatively charged functional groups. Anionic surfactants are discussed at some length in U.S. Pat. No. 3,929,678 to Laughlin et.al, issued Dec. 30, 1975 at column 23, line 58 through column 29, line 23, herein incorporated by reference. Soaps are included within the category of anionic surfactants. A soap is a $C_8$–$C_{22}$ alkyl fatty acid salt of an alkali metal, alkaline earth metal, ammonium; alkyl substituted ammonium or alkanolammonium. Sodium salts of tallow and coconut fatty acids, and mixtures thereof, are most common.

Another important class of anionic compounds is the water-soluble salts, particularly the alkali metal salts, of organic sulfur reaction products having in their molecular structure an alkyl radical containing from about 8 to 22 carbon atoms and a radical selected from the group consisting of sulfonic acid and sulfuric acid ester radicals. Organic sulfur-based anionic surfactants include the salts of $C_{10}$–$C_{14}$ alkylbenzene sulfonates, $C_{10}$–$C_{22}$alkene sulfonates, $C_{10}$–$C_{22}$alkyl ether sulfonates, $C_{10}$–$C_{22}$alkyl sulfates, $C_4$–$C_{10}$dialkyl sulfosuccinates, $C_{10}$–$C_{22}$acyl methionates, alkyl diphenyloxide sulfonates, alkyl naphthalene sulfonates, and 2-acetamido hexadecane sulfonates. Also included are nonionic alkoxylates having a sodium alkylene carboxylate moiety linked to a terminal hydroxyl group of the nonionic alkoxylate through an ether bond. Counter-ions to the salts of all the foregoing may be those of alkali metal, alkaline earth metal, ammonium; alkanolammoninm and alkylammonium types. Anionic surfactants which are water-soluble alkylbenzene sulfonate salts of organic sulfur-reaction products are described in U.S. Pat. Nos. 2,220,099 and 2,477,383, herein incorporated by reference. Especially valuable are linear straight-chain alkylbenzene sulfonates in which the average number of carbon atoms in the alkyl group is from about 11 to 13, abbreviated as $C_{11}$–$C_{13}$ LAS. Preferred anionic surfactants of this type are the alkyl polyethoxylate sulfates, particularly those in which the alkyl group contains from about 10 to about 22, preferably from about 12 to about 18 carbon atoms, and wherein the polyethoxylate chain contains from about 1 to about 15 ethoxylate moieties, preferably from about 1 to about 3 ethoxylate moities.

Other anionic surfactants of this type include sodium alkyl glyceryl ether sulfonates, especially those ethers of higher alcohols derived from tallow and coconut oil, sodium coconut oil fatty acid monoglyceride sulfonates and sulfates, sodium or potassium salts of alkyl phenol ethylene oxide ether sulfates containing from about 1 to about 10 units of ethylene oxide per molecule and wherein the alkyl group contains from about 8 to about 12 carbon atoms, and sodium or potassium salts of alkyl ethylene oxide ether sulfates containing about 1 to about 10 units of ethylene oxide per molecule and wherein the alkyl group contains from about 10 to about 20 carbon atoms.

Also included are water-soluble salts of esters of alpha-sulfonated fatty acids containing from about 6 to 20 carbon atoms in the fatty acid group and from about 1 to 10 carbon atoms in the ester group, water-soluble salts of 2-acyloxy-alkane-1-sulfonic acids containing from about 2 to 9 carbon atoms in the acyl group and from about 9 to about 23 carbon atoms in the alkane moiety, alkyl ether sulfonates containing from about 10 to about 20 carbon atoms in the alkyl group and from about 1 to about 30 moles of ethylene oxide; water-soluble salts of olefin sulfonates containing from about 12 to 24 carbon atoms; and beta-alkoxy alkane sulfonates containing from about 1 to 3 carbon atoms in the alkyl group and from about 8 to 20 carbon atoms in the alkane moiety.

Another class of usable anionic surfactants is the N-alkyl substituted succinates.

2. Nonionic Surfactants:

Nonionic surfactants may be broadly defined as compounds produced by the condensation of alkylene oxide groups with an organic hydrophobic material, which may be aliphatic or alkyl aromatic in nature. The length of the hydrophilic or polyoxyalkylene radical which is condensed with any particular hydrophobic group can be readily adjusted to yield a water soluble compound having the desired degree of balance between hydrophilic and hydrophobic elements. Some nonionic surfactants are discussed in U.S. Pat. No. 3,929,678 to Laughlin et. al., issued Dec. 30, 1975, at column 13, line 14 through column 16, line 6, herein incorporated by reference.

Illustrative, but not limiting, examples of various suitable nonionic surfactant types are:

(a) polyoxyethylene or polyoxypropylene condensates of aliphatic carboxylic acids, whether linear or branched-chain and saturated or unsaturated, containing from about 8 to about 18 carbon atoms in the aliphatic chain and incorporating from about 5 to about 50 ethylene oxide and/or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid, and lactic acid.

(b) polyoxyethylene or polyoxypropylene condensates of aliphatic alcohols, whether linear or branched-chain and saturated or unsaturated, containing from about 6 to about 24 carbon atoms and incorporating from about 5 to about 50 ethylene oxide and/or propylene oxide units. Suitable alcohols include "coconut" fatty alcohol "tallow" fatty alcohol, lauryl alcohol, myristyl alcohol and oleyl alcohol.

(c) polyoxyethylene or polyoxypropylene condensates of alkyl phenols. These compounds include the condensation products of alkyl phenols having an alkyl group containing from about 6 to 12 carbon atoms in either a straight chain or branched configuration with ethylene and/or propylene oxide, the ethylene and/or propylene oxide being present as about 5 to 25 moles of ethylene and/or propylene oxide per mole of alkyl phenol. The alkyl substituent in such compounds can be derived, for example, from polymerized propylene, diisobutylene, and the like. Examples of compounds of this type include nonyl phenol condensed with about 9.5 moles of ethylene oxide per mole of phenol; dinonyl phenol condensed with about 12 moles of ethylene oxide per mole of phenol; dinonyl phenol condensed with about 15 moles of ethylene oxide per mole of phenol; and diisooctyl phenol condensed with about 15 moles of ethylene oxide per mole of phenol. Commercially available nonionic surfactants of this type include "IGEPAL CO-630", marketed by the GAF Corporation of Wayne, N.J., and "TRITON X-45, X-114, X-100, and X-102", all marketed by the Rohm and Haas Company of Philadelphia, PA. Preferred nonionic surfactants in this category are water-soluble surfactants sold by Rohm and Haas Company under the trademark "TRITON". TRITON X-100, which is an octylphenoxypolyethoxyethanol containing an average of 10 moles of ethylene oxide, is particularly preferred for use in the sprayable cleaning gel composition according to the present invention.

3. Cationic Surfactants

Cationic surfactants may also be used in the sprayable cleaning gel composition according to the present invention. However, when the preferred polyacrylic acid thickener is used, cationic surfactants must be, if used, of high molecular weight; anionic or nonionic surfactants are preferred. Suitable cationic surfactants include quaternary ammonium surfactants having the formula:

$$[R^1(OR^2)_y][R^3(OR^2)_y]R^4N^+X^-$$

wherein $R^2$ is an alkyl or alkyl benzyl group having from about 8 to about 18 carbon atoms in the alkyl chain; each $R^2$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^3$ is selected from the group consisting of $C_1$–$C_4$ hydroxyalkyl, benzyl, ring structures formed by joining the two $R^3$ groups, $—CH_2CHOHCHOHCOR^5CHOHCH_2OH—$ wherein $R^5$ is any hexose or hexose polymer having a molecular weight less than about 1000, and hydrogen when y is not 0; $R^4$ is the same as $R^3$ or is an alkyl chain wherein the total number of carbon atoms of $R^1$ plus $R^4$ is not more than about 18; each y is from about 0 to about 10 and the sum of the y values is from 0 to about 15; and X is any compatible anion.

4. Other Surfactants

Amphoteric surfactants, also called ampholytic surfactants, may be broadly defined as aliphatic derivatives of secondary or tertiary amines, or aliphatic derivatives of heterocyclic secondary and tertiary amines in which the aliphatic radical can be straight chain or branched, and wherein one of the aliphatic substituents contains from about 8 to about 18 carbon atoms and at least one contains an anionic water-solubilizing group, e.g. carboxy, surfate, or sulfonate. See U.S. Pat. No. 3,929,678 to Laughlin et. al., issued Dec. 30, 1975 at column 19, lines 18–35 (herein incorporated by reference) for examples of amphoteric surfactants.

Zwitterionic surfactants may be broadly described as derivatives of secondary and tertiary amines, derivatives of heterocyclic secondary and tertiary amines, or derivatives of quaternary ammonium, quaternary phosphonium, or tertiary sulfonium compounds.

Thickening Agent (Thickener)

The sprayable cleaning gel composition according to the present invention has a preferred viscosity in the range of about 900 cP to about 5,550 cP at standard temperature and pressure (25 degrees Centigrade and 1 atmosphere pressure), preferably from about 1,500 cP to about 4,500 cP and most preferably from about 2,700 cP to about 3,000 cP. In order to achieve the target viscosity, the addition of a thickening agent (thickener) is required, in an amount sufficient to give the composition the consistency of a gel with a viscosity in the preferred range. Generally in this regard, the thickening agent should be present in a range from about 0.01% to about 10% of the composition. Suitable thickening agents include polyacrylic acid polymers in a range from about 0.01% to about 2% of the composition, preferably in a range from about 0.05% to about 1% of the composition, and more preferably in a range from about 0.1% to about 0.5% of the composition, and most preferably about 0.2% of the composition.

While many thickening agents are known for increasing fluid viscosity, the preferred polyacrylic acid polymers exhibit a surprising and unexpected tendency to allow free flow under pressure for good sprayability of the sprayable cleaning gel composition, yet to prevent downward flow due to gravity once the sprayable cleaning gel composition is in place on a surface to be cleaned.

The preferred thickener for use in formulating the sprayable cleaning gel composition according to the present invention is a polyacrylic acid powder. A family of commercially available crosslinked polyacrylic acid powders which are suitable for use in the practice of the present invention is sold by B.F. Goodrich Specialty Chemicals of Cleveland, Ohio, under the name "CARBOPOL". The product CARBOPOL EZ-1, which has a molecular weight of about 4,000,000, is particularly suited for use in formulating the sprayable cleaning gel composition hereof.

Brookfield yield value is defined as the minimum shear stress required to initiate flow in a non-Newtonian fluid. Preferably, the thickening agent used in the practice of the present invention will be one which has a Brookfield yield value in a range from about 16 to about 140, more preferably from about 40 to about 120, and most preferably from about 80 to about 120. A high yield Brookfield value indicates that the minimum shear stress required to initiate flow will be greater than that effected by the force of gravity, thus allowing the sprayable cleaning gel composition to non-runningly cling to (ie., dwell on) the surface onto which it has been sprayed, rather than running downwardly or dripping.

The thickening agent provides a moisture residue on a surface that has been sprayed with the sprayable cleaning gel composition and then wiped clean by a wiping article. This moisture residue causes the tendency of the surface to acquire a static electric charge due to wiping to be noticeably minimized. This feature is important as the static electric charge tends to be greatest immediately after wiping a surface, and static electric charge tends to cause dust to accumulate on the surface. Therefore, by minimizing the static electric charge, the surface will appear cleaner for a longer time than would be expected for surface cleaners not including a thickening agent.

Supplemental Solvent

A supplemental solvent is, optionally, included as a component of the present invention to help dissolve oil-based materials in the water-based sprayable cleaning gel composition 20, whether those oil-based materials are part of the sprayable cleaning gel composition such as, e.g., oil-based fragrances, or whether the oil-based material is a soil to be cleaned off of a surface. Where used, the supplemental solvent is present in an amount ranging from about 1% to about 20% of the composition, preferably from about 2% to about 8% of the composition, and most preferably from about 2% to about 6% of the composition. Glycol ethers are a preferred class of supplemental solvents in the practice of the present invention. Usable glycol ethers include propylene glycol methyl ether (CAS No. 107-98-2), dipropylene glycol methyl ether (CAS No. 34590-94-8), ethylene glycol n-butyl ether (CAS No. 111-76-2), and propylene glycol t-butyl ether (CAS No. 57018-52-7), which is the most preferred supplemental solvent for use in the practice of the present invention.

Dispersant

In order to promote homogeneous distribution of the mixture components in the sprayable cleaning gel composition and to break up and disperse soils in application of the sprayable cleaning gel composition, in a preferred embodiment of the present invention, a dispersant may, optionally, be included in the sprayable cleaning gel composition. Polycarboxylates are preferred dispersants in the practice of the present invention in an amount ranging from about 0.005% to about 5% of the composition, preferably from about 0.01% to about 1% of the composition, and most preferably from about 0.05% to about 0.5% of the composition. Suitable polycarboxylates include carboxylic acid-olefin copolymers and carboxylic acid-vinyl ether copolymers sold by BASF Specialty Products of Parsippany, N.J. under the name "SOKOLAN". In particular, SOKOLAN CP-9, a sodium salt of a maleic acid-olefin copolymer, has been found useful in the practice of the present invention. Other dispersants which may be used are acrylic detergent polymers.

Base

Addition of a base to the sprayable cleaning gel composition may be used to raise the pH of the composition to a value from about 5 to about 11.5 in order to uncoil the polymeric molecules of the thickener and precipitate gelatinous thickening of the composition. Alternatively, ammonia may be used as a component of the sprayable cleaning gel composition to contribute to cleaning effectiveness. Adding a base may not be necessary if alcohol is present in the liquid carrier or if an organic acid is present in the sprayable cleaning gel composition because these components will also precipitate thickening of the mixture if used in sufficient quantity. Where used, sufficient base should be added to adjust the pH to the desired level of between about 5 and 11.5. Suitable bases include sodium hydroxide, ammonium hydroxide, morpholine, and amines such as, e.g., triethanolamine.

Organic Acids

In some formulations of the sprayable cleaning gel composition according to the present invention, one or more organic acids may optionally be added to the sprayable cleaning gel composition as a cleaning aid. Preferred organic acids are acetic acid, citric acid, and mixtures thereof. Where present, organic acids are used in a range from about 1% to about 5% of the composition. It is preferred that organic acids not be used together with ammonia.

Anti-Static Agent

The sprayable cleaning gel composition 20 according to the present invention advantageously may include an agent which enhances the innate anti-static feature of the thickening agent, as discussed hereinabove, by actively preventing static electric charge build-up on a surface while the sprayable cleaning gel composition is being wiped therefrom, as well as for a period of time thereafter. Where present, the anti-static agent is used in a range of from about 0.05% to about 1.0% of the composition, preferably about 0.2% of the composition. An example of a suitable anti-static agent therefor is Eccostat 501 manufactured by Eastern Color & Chemical Co. of Providence, R.I. Eccostat 501 is a nonionic ester complex. Because the anti-static feature of the thickening agent tends to decrease over time (in about a day or so), the inclusion of an anti-static agent provides long term (on the order of weeks or longer) prevention of static electric charge build-up on a surface upon which the sprayable cleaning gel composition 20 containing the anti-static agent has been wiped thereoff. Accordingly, with inclusion of the anti-static agent, the surface will appear cleaner, both at the time of cleaning and for a long time thereafter. Interestingly, the ability of the anti-static agent to prevent build-up of static electric charge during wiping of the surface being cleaned is most effective for plastic surfaces, which would otherwise tend to readily develop a static electric charge upon being wiped.

It has been discovered that an excellent anti-static agent is a nonionic water soluble silicone based lubricant and softener, which, it has been found in testing, not only improves surface wiping, as is expected; but, in addition to providing surfactant properties, also unexpectedly provides exceptional anti-static properties. An example of a nonionic water soluble silicone based lubricant and softener of this class is Eccolube RT-5-8 of Eastern Color & Chemical Co. of Providence, R.I. Eccolube RT-5-8 is sold by its manufacturer for use as a lubricating and softening agent.

In tests performed at substantially standard temperature and pressure with Eccolube RT-5-8 as the anti-static agent in the sprayable cleaning gel composition, the following results were obtained: at about 0.50% of the composition, excellent anti-static properties were observed, and with respect to wiping the sprayable cleaning gel composition off a surface, slight smearing, no hazing and very low resistance to wiping were observed; at about 0.30% of the composition, excellent anti-static properties were observed, and with respect to wiping the sprayable cleaning gel composition off a surface, no smearing, no hazing, smooth finish and very low resistance to wiping were observed; at about 0.20% of the composition, excellent anti-static properties were observed, and with respect to wiping the sprayable cleaning gel composition off a surface, no smearing, no hazing, smooth finish and very low resistance to wiping were observed; at about 0.10% of the composition, unpredictably excellent or poor anti-static properties were at times observed; and at about 0.05% of the composition, poor anti-static properties were observed and fair wiping characteristics were observed. It is to be understood that while the preferred lower limit of about 0.05% of the sprayable cleaning gel composition 20 could be lower, the preferred lower limit is based upon increasing poorness of the anti-static properties, and that while the preferred upper limit of about 0.50% of the sprayable cleaning gel composition could be higher, the preferred upper limit is based upon increasing poorness of wiping characteristics (such as for example smearing), as well as cost effectiveness.

Other Adjuvants

Other adjuvants such as fragrances, dyes, a chelant such as EDTA, or additional ingredients may, optionally, be added to the sprayable cleaning gel composition hereof, so long as they are compatible with stable storage life of the composition.

Advantages of the Sprayable Cleaning Gel Composition

Became of the thickness, viscosity, and high Brookfield yield value of the sprayable cleaning gel composition 20 of the present invention as compared to the prior art spray cleaners, the sprayable cleaning gel composition 20 dwells by remaining substantially motionless where it is sprayed on a surface, such as the vertical surface 25 depicted in FIG. 1, until it is spread thereon and wiped therefrom by a user. In this specification, the time that the sprayable cleaning gel composition 20 remains on the surface, substantially without running downwardly due to the effect of gravity, is referred to as 'dwell time'. Because of their relatively low viscosity, the currently available sprayable window cleaners and all-purpose cleaners show little or no tendency to remain in place on a vertical surface when sprayed thereon, and therefore, these presently available cleaners exhibit a very short dwell time on a vertical surface. In contrast, the sprayable cleaning gel composition 20 according to the present invention shows a marked tendency to cling to and dwell on a surface when sprayed thereon exhibiting an unexpected increase in dwell time, yet the sprayable cleaning gel composition 20 is easily spread out and wiped off of the surface, using a wiping article such as a conventional paper towel or a cloth rag. If the sprayable cleaning gel composition 20 is left on a surface for an extended period of time, it may dry out partially or completely and it may therefore become necessary to spray additional sprayable cleaning gel composition 20 on the dried sprayable cleaning gel composition before wiping.

The extended dwell time of the sprayable cleaning gel composition 20 of the present invention leads to several significant improvements over the prior art cleaners. For example, a spray applicator 10 fried with sprayable cleaning gel composition 20 according to the present invention will last longer than a similar spray applicator fried with a low viscosity (watery) prior art cleaner because there will be less waste due to runoff.

The extended dwell time of the sprayable cleaning gel composition 20 on the vertical surface 25 means that the active cleaning ingredients in the sprayable cleaning gel composition remain in contact with the surface longer than would otherwise be possible if runoff occurred. In addition, there will be significantly reduced risk of damaging or discoloring furniture, plants, or other items (not shown) which may be disposed below the surface 25 and which may otherwise receive runoff from the surface if the low viscosity (watery) prior art cleaners are used.

Figure 2:
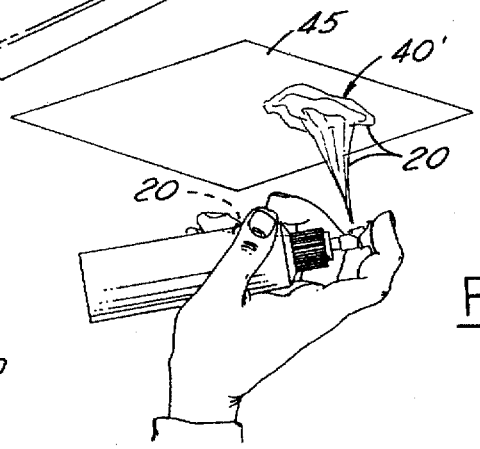
FIG. 2 is a perspective view of a spray applicator applying a sprayable cleaning gel composition to a flattened horizontal undersurface in accordance with the present invention.

As shown in FIG. 2, the sprayable cleaning gel composition 20 hereof may be sprayed onto a horizontal undersurface 45, such as, e.g., a ceiling tile or the underside of a cabinet, to thereby form a deposit 40' thereon, wherein the deposit will remain substantially non-running so as not to bunch up or drip off of that undersurface.

Figure 3B:
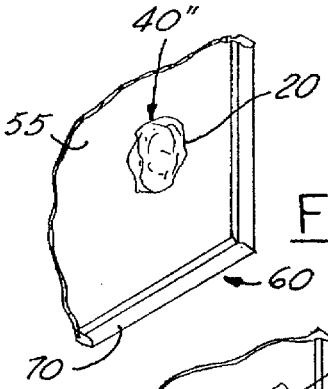
FIG. 3B is a cutaway perspective view of the sprayable cleaning gel composition hereof after being sprayed on to a framed picture.
Figure 3A:
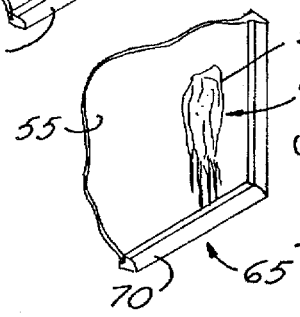
(PRIOR ART) FIG. 3A
FIG. 3A is a cutaway perspective view of a prior art spray cleaner after being sprayed on to a framed picture.
Figure 4:
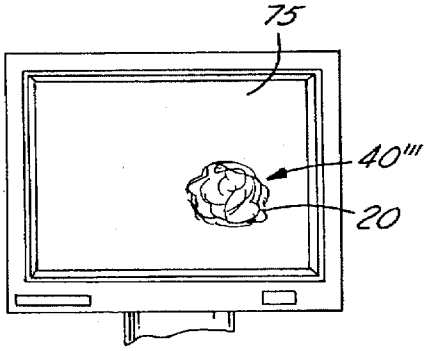
FIG. 4 is a front plan view of a computer monitor with the sprayable cleaning gel composition hereof applied thereto.

As shown in FIG. 3A, if a prior art watery spray cleaner 50 is applied to a glass surface 55 of a framed picture 65, the prior art cleaner 50 has a tendency to run down the glass 55 under the effect of gravity, which may act-ally lead to seepage between the glass 55 and the frame 70, and possibly to damaging the picture housed behind the glass 55. By contrast, and as shown in FIG. 3B, the sprayable cleaning gel composition 20 according to the present invention, while sprayable, stays in place as a stable deposit 40" on the glass 55 and will not run between the glass and the frame 70. Somewhat similarly, as shown in FIG. 4, the sprayable cleaning gel composition 20 according to the present invention may be sprayed as a deposit 40'" on the glass screen 75 of a computer monitor 80 without risking that the sprayable cleaning gel composition will seep into the computer monitor interior (with a risk of potentially shorting out internal electronic circuits therein) or drip down below the monitor 80, which could conceivably damage the computer keyboard (not shown).

Another advantage of the extended dwell time of the sprayable cleaning gel composition 20 hereof is that it makes it easy to identify areas which have been sprayed but which have not yet been wiped, particularly if a colorant is added to the sprayable cleaning gel composition 20. An additional advantage of the sprayable cleaning gel composition 20 according to the present invention is that a person using it actually saves overall cleaning time because repeat applications, which would otherwise be needed due to prior art product runoff, are eliminated when using the sprayable cleaning gel composition hereof due to its tendency to stay in place.

The advantage associated with the aforementioned anti-static property has very beneficial results with respect to plastic materials, which would otherwise acquire undesirable static electric charge during the wiping of the surface thereof. Another very beneficial result is with respect to eye glasses, which may be composed of glass, plastic, or other materials, wherein the user's lenses will remain cleaner longer when the sprayable gleaning gel composition is used to clean them, particularly wherein the composition includes the aforementioned anti-static agent. Dust build-up is frequently associated with static electric attraction between the dust particles and the surface; accordingly, the sprayable cleaning gel composition will retard dust accumulation on the surface, and this effect is enhanced markedly with the inclusion of an anti-static agent.

Spay Applicator

As noted, the spray applicator hereof is of generally conventional construction. It may be of the aerosol type (having an internally pressurized gas for propelling the liquid contents thereof) or of the manual pump or trigger type (wherein pressing the spray head or pulling a trigger causes pressurization therewithin for propelling the liquid contents thereof). In either case, the spray applicator will include a container 85 having a spray head 90 with an orifice 95 formed therein for the spraying passage of the sprayable cleaning gel composition 20 therethrough. It is preferred that the orifice 95 have a diameter of about 0.010 to about 0.040 inches, most preferably about 0.025 inches. The spray applicator container 85 has a reservoir 100 formed therein for housing the sprayable cleaning gel composition 20, and the reservoir 100 is placeable into fluid communication with the spray head 90 when the spray head is pushed downwardly, whereupon the pressurized gas/air therewithin propels the sprayable cleaning gel composition sprayably thereout through the orifice. The preferred spray applicator is the trigger spray type.

Preferred Cleaning Method

The present invention also encompasses a method of cleaning a surface such as that shown at 25. A method in accordance with the present invention, generally, comprises the steps of: 1) spraying a substantially homogeneous sprayable cleaning gel composition 20 onto a surface 25 to be cleaned, the sprayable cleaning gel composition comprising: from about 75% to about 98% of a liquid carrier; from about 0.005% to about 20% of a surfactant; from about 0.01% to about 10% of a water-soluble polymeric thickening agent, wherein the sprayable cleaning gel composition has a viscosity from about 900 cP to about 5,550 cP, and wherein the sprayable cleaning gel composition substantially clings to and dwells on the surface rather than running downwardly thereon under the effect of gravity at substantially standard temperature and pressure; optionally comprising from about 0.05% to about 0.50% of an anti-static agent; optionally comprising from about 0.001% to about 5% of a dispersant; and optionally comprising from about 1% to about 20% of at least one supplemental solvent; 2) spreading the sprayable cleaning gel composition 20 around the surface with a wiping article, such as for example a cloth rag or a paper towel; and 3) wiping the sprayable cleaning gel composition 20 off the surface 25 with the wiping article.

EXAMPLES

The following examples are intended to be illustrative, and not restrictive.

Example 1

A viscous sprayable cleaning gel composition was made up at substantially standard temperature and pressure in a suitable glass mixing vessel. As each component was added, the mixture was stirred to promote intermixing. A list of the components may be found in Table 1, in the order of their addition to the mixture.

TABLE 1

| COMPONENT | AMOUNT (lbs.) |
|---|---|
| WATER | 94.83 |
| THICKENER[1] | 1.0 |
| FRAGRANCE-SURFACTANT PREMIX[2] | 0.07 |
| DISPERSANT[3] | 0.1 |
| SOLVENT[4] | 4.0 |
| TOTAL | 100.0 |

Wherein the superscripts of Table 1. are defined as follows:
[1]A polyacrylatelpolyalcohol copolymer sold by Burlington Chemical of Burlington, NC under the name "BURCO THIX PCS".
[2]0.05 lbs. of oil-based fragrance sold by the Aroma Tech Company of Somerville, N.J. as 'Fruity' No. 239575 was mixed in a separate container with 0.02 lbs. of an octylphenoxypolyethoxyethanol nonionic surfactant sold by Rohm and Haas of Philadelphia, PA as TRITON X-100. This premix was then added to the total composition in the listed sequence.
[3]A solution of 75% water and 25% the sodium salt of a maleic acid-olefin copolymer, sold by BASF Corp. of Parsippany, N.J. as Sokalan CP-9.
[4]Propylene glycol t-butyl ether sold by Arco Chemical of Houston, TX as PTB.

This sprayable cleaning gel composition was then placed into a manual pump spray applicator Model SSA manufactured by Calmar, Inc. having an orifice size of 0.025 inches in diameter, and the sprayable cleaning gel composition was not found to be finely sprayable, but rather sprayed globs onto the surface. Excessive pressure was required to force the sprayable cleaning gel composition out of the spray orifice, and distribution was not good. The unsatisfactory performance of the sprayable cleaning gel composition of Table 1 was attributed to the selected thickener.

Example 2

This experiment was essentially a repeat of the process of Example 1, but a polyacrylic acid thickener was substituted for the thickener previously used, and the pH of the mixture was adjusted to activate the new thickener. A sprayable cleaning gel composition was made up at substantially standard temperature and pressure, in a suitable glass mixing vessel. As each component was added, the mixture was stirred to promote intermixing. A list of the components may be found in Table 2, in the order of their addition to the mixture.

TABLE 2

| COMPONENT | AMOUNT (lbs.) |
|---|---|
| WATER | 95.43 |
| THICKENER[1] | 0.2 |
| FRAGRANCE-SURFACTANT PREMIX[2] | 0.07 |
| DISPERSANT[3] | 0.1 |
| SUPPLEMENTAL SOLVENT[4] | 4.0 |
| BASE[5] | 0.2 |
| TOTAL | 100.0 |

Wherein the superscripts of Table 2. are defined as follows:
[1]A cross-linked polyacrylic acid polymer sold by B.F Goodrich of Cleveland, OH as CARBOPOL EZ-1 in powder form. The mixture was then stirred until the CARBOPOL powder was uniformly dispersed.

TABLE 2-continued

| COMPONENT | AMOUNT (lbs.) |
|---|---|

[2]0.05 lbs. of oil-based fragrance sold by the Aroma Tech Company of Somerville, N.J. as 'Fruity' No. 289575 was mixed in a separate container with 0.02 lbs. of an octylphenoxypolyethoxyethanol nonionic surfactant sold by Rohm and Haas of Philadelphia, PA as TRITON X-100. This premix was then added to the total composition in the listed sequence.
[3]A solution of 75% water and 25% the sodium salt of a maleic acid-olefin copolymer, sold by BASF Corp. of Parsippany, N.J. as Sokalan CP-9.
[4]Propylene glycol t-butyl ether sold by Arco Chemical of Houston, TX as PTB. A water soluble blue dye was then added to the mixture in an amount sufficient to impact a medium blue tint to the otherwise transparent mixture.
[5]Then a solution of 50% water and 50% sodium hydroxide was added, with stirring, in an amount sufficient to raise the pH of the solution to a value between 5 and 8. 0.2 lb of the NaOH solution was required to effect this change in pH, which caused the mixture to thicken into a sprayable cleaning gel composition having a measured viscosity of 1,920 cP.

This sprayable cleaning gel composition was then placed into a manual pump spray applicator Model SSA manufactured by Calmar, Inc. having an orifice size of 0.025 inches in diameter, and the sprayable cleaning gel composition was found to be sprayable and to have a surprising tendency to non-runningly cling to and to dwell on surfaces disposed at any orientation when sprayed thereon, yet the sprayable cleaning gel composition provided excellent surface cleaning while being easily spread out and wiped off with a wiping motion of a wiping article, such as for example a paper towel or a cloth rag, leaving a clean surface.

Example 3

In this example, the process of Example 2 was repeated with the substitution of an alcohol for the supplemental PTB solvent. A sprayable cleaning gel composition was made up at substantially standard temperature and pressure in a suitable glass mixing vessel. As each component was added, the mixture was stirred to promote intermixing. A list of the components may be found in Table 3, in the order of their addition to the mixture.

TABLE 3

| COMPONENT | AMOUNT (lbs.) |
|---|---|
| WATER | 95.63 |
| FRAGRANCE-SURFACTANT PREMIX[1] | 0.07 |
| DISPERSANT[2] | 0.1 |
| ALCOHOL[3] | 4.0 |
| THICKENER[4] | 0.2 |
| TOTAL | 100.0 |

Wherein the superscripts of Table 3 are defined as follows:

1. 0.05 lbs. of oil-based fragrance sold by the Aroma Tech Company of Somerville, N.J. as 'Fruity' No. 239575 was mixed in a separate container with 0.02 lbs. of an octylphenoxypolyethoxyethanol nonionic surfactant sold by Rohm and Haas of Philadelphia, Pa. as TRITON X-100. This premix was then added to the total composition in the listed sequence.

2. A solution of 75% water and 25% the sodium salt of a maleic acid-olefin copolymer, sold by BASF Corp. of Parsippany, N.J. as Sokalan CP-9.

3. Isopropyl alcohol.

4. A cross-linked polyacrylic acid polymer sold by B.F. Goodrich of Cleveland, Ohio as CARBOPOL EZ-1 is powder form. The mixture was then stirred until the CARBOPOL powder was uniformly dispersed.

No pH adjustment was required in this example, because the alcohol was able to activate the thickener. It is believed that the alcohol activation is due to the formation of hydrogen bonds between the —OH group of the alcohol and a carboxyl group on the polyacrylic acid.

This sprayable cleaning gel composition, having a viscosity of 3,320 cP, was then placed into a manual pump spray applicator Model SSA manufactured by Calmar, Inc. having an orifice size of 0.025 inches in diameter, and the sprayable cleaning gel composition was found to be sprayable and to have a surprising tendency to non-runningly cling to and to dwell on surfaces disposed at any orientation when sprayed thereon, yet the sprayable cleaning gel composition provided excellent surface cleaning while being easily spread out and wiped off with a wiping motion of a wiping article, such as for example a paper towel or a cloth rag, leaving a clean surface.

Example 4

A sprayable cleaning gel composition was made up at substantially standard temperature and pressure, in a suitable glass mixing vessel. As each component was added, the mixture was stirred to promote intermixing. A list of the components may be found in Table 4, in the order of their addition to the mixture.

TABLE 4

| COMPONENT | AMOUNT (lbs.) |
|---|---|
| FRAGRANCE-SURFACTANT PREMIX[1] | 0.07 |
| DISPERSANT[2] | 0.1 |
| WATER | 95.18 |
| ANTI-STATIC AGENT[3] | 0.25 |
| SOLVENT[4] | 4.0 |
| THICKENER[5] | 0.2 |
| BASE[6] | 0.2 |
| TOTAL | 100.0 |

Wherein the superscripts of Table 4. are defined as follows:
[1]0.05 lbs. of oil-based fragrance sold by the Aroma Tech Company of Somerville, N.J. as 'Fruity' No. 239575 was mixed in a separate container with 0.02 lbs. of an octylphenoxypolyethoxyethanol nonionic surfactant sold by Rohm and Haas of Philadelphia, PA as TRITON X-100. This premix was then added to the total composition in the listed sequence.
[2]A solution of 75% water and 25% the sodium salt of a maleic acid-olefin copolymer, sold by BASF Corp. of Parsippany, N.J. as Sokalan CP-9.
[3]A nonionic ester complex sold by Eastern Color & Chemical Co. of Providence, RI as Eccostat 501.
[4]Propylene glycol t-butyl ether sold by Arco Chemical of Houston, TX as PTB.
[5]A cross-linked polyacrylic acid polymer sold by B.F Goodrich of Cleveland, OH as CARBOPOL EZ-1 in powder form. The mixture was then stirred until the CARBOPOL powder was uniformly dispersed.
[6]A solution of 50% water and 50% NaOH, added last, by stirring which serves to raise the pH of the composition to a value of between 5 and 8.

This sprayable cleaning gel composition, having a viscosity of 1,920 cP, when placed into a manual pump spray applicator Model SSA manufactured by Calrnar, Inc. having an orifice size of 0.025 inches in diameter, was found to be sprayable, cling in a non-running manner to the surface, and when wiped thereoff left the surface clean with virtually no static electric charge on the surface.

Example 5

A sprayable cleaning gel composition was made up at substantially standard temperature and pressure, in a suitable glass mixing vessel. As each component was added, the mixture was stirred to promote intermixing. A list of the components may be found in Table 5, in the order of their addition to the mixture.

TABLE 5

| COMPONENT | AMOUNT (lbs.) |
|---|---|
| FRAGRANCE[1] | 0.1 |
| ANTI-STATIC AGENT AND SURFACTANT[2] | 0.2 |
| DISPERSANT[3] | 0.1 |
| WATER | 96.15 |
| SOLVENT[4] | 3.0 |
| THICKENER[5] | 0.15 |
| SOLVENT[6] | 0.15 |
| BASE[7] | 0.15 |
| TOTAL | 100.0 |

Wherein the superscripts of Table 5. are defined as follows:
[1]0.1 lbs. of oil-based fragrance sold by the Aroma Tech Company of Somerville, N.J. as 'Fruity' No. 239575.
[2]A nonionic liquid silicone emulsion lubricant/softener sold by Eastern Color & Chemical Co. of Providence, RI as Eccolube RT-5-8.
[3]A solution of 75% water and 25% the sodium salt of a maleic acid-olefin copolymer, sold by BASF Corp. of Parsippany, N.J. as Sokalan CP-9.
[4]Propylene glycol t-butyl ether sold by Arco Chemical of Houston, TX as PTB.
[5]A cross-linked polyacrylic acid polymer sold by B.F Goodrich of Cleveland, OH as CARBOPOL EZ-1 in powder form. The mixture was then stirred until the CARBOPOL powder was uniformly dispersed.
[6]A glycol ether sold by Dow Chemical Co. of Midland, MI.
[7]A solution of 50% water and 50% NaOH, added last, by stirring which serves to raise the pH of the composition.

This sprayable cleaning gel composition, having a pH of 7.8, when placed into a manual pump spray applicator Model SSA manufactured by Calmar, Inc. having an orifice size of 0.025 inches in diameter, was found to be sprayable, cling in a non-running manner to the surface, and when wiped thereoff left the surface clean with virtually no static electric charge on the surface. The viscosity was measured to be 450 cP.

The sprayable cleaning gel composition of Table 5 was then subjected to spray/cling tests. The tests were conducted at substantially standard temperature and pressure as follows: the composition was sprayed once onto a vertical mirror 22 inches long by 18 inches wide from a distance of 4 inches using the aforesaid pump sprayer with an orifice of 0.025 inches. The following results were obtained:

| Run Distance | Elapsed Time |
|---|---|
| 4 inches | 90 seconds |
| 6 inches | 124 seconds |
| 7 inches | 160 seconds (then no running) |

Based upon the spray/cling tests, it was determined that even though the composition sprayed timely, the composition was inadequate for the purpose of the present invention in that the composition ran too readily.

Example 6

A sprayable cleaning gel composition was made up at substantially standard temperature and pressure, in a suitable glass mixing vessel. As each component was added, the mixture was stirred to promote intermixing. A list of the components may be found in Table 6, in the order of their addition to the mixture.

TABLE 6

| COMPONENT | AMOUNT (lbs.) |
|---|---|
| FRAGRANCE[1] | 0.1 |
| ANTI-STATIC AGENT AND SURFACTANT[2] | 0.2 |
| DISPERSANT[3] | 0.1 |
| WATER | 96.125 |
| SOLVENT[4] | 3.0 |
| THICKENER[5] | 0.15 |
| SOLVENT[6] | 0.15 |
| BASE[7] | 0.175 |
| TOTAL | 100.0 |

Wherein the superscripts of Table 6. are defined as follows:
[1]0.1 lbs. of oil-based fragrance sold by the Aroma Tech Company of Somerville, N.J. as 'Fruity' No. 239575.
[2]A nonionic liquid silicone emulsion lubricant/softener sold by Eastern Color & Chemical Co. of Providence, RI as Eccolube RT-5-8.
[3]A solution of 75% water and 25% the sodium salt of a maleic acid-olefin copolymer, sold by BASF Corp. of Parsippany, N.J. as Sokalan CP-9.
[4]Propylene glycol t-butyl ether sold by Arco Chemical of Houston, TX as PTB.
[5]A cross-linked polyacrylic acid polymer sold by B.F Goodrich of Cleveland, OH as CARBOPOL EZ-1 in powder form. The mixture was then stirred until the CARBOPOL powder was uniformly dispersed.
[6]A glycol ether sold by Dow Chemical Co. of Midland, MI.
[7]A solution of 50% water and 50% NaOH, added last, by stirring which serves to raise the pH of the composition.

This sprayable cleaning gel composition, having a pH of 8.0, when placed into a manual pump spray applicator Model SSA manufactured by Calmar, Inc. having an orifice size of 0.025 inches in diameter, was found to be sprayable, cling in a non-running manner to the surface, and when wiped thereoff left the surface clean with virtually no static electric charge on the surface. The viscosity was measured to be 900 cP.

The sprayable cleaning gel composition of Table 6 was then subjected to spray/cling tests. The tests were conducted at substantially standard temperature and pressure as follows: the composition was sprayed once onto a vertical mirror 22 inches long by 18 inches wide from a distance of 4 inches using the aforesaid pump sprayer with an orifice of 0.025 inches. The following results were obtained:

| Run Distance | Elapsed Time |
|---|---|
| 4 inches | 100 seconds |
| 6 inches | 310 seconds |
| 8 inches | 370 seconds (then no running) |

Based upon the spray/cling tests, it was determined that the composition sprayed finely and the dwell time was adequate for the purpose of the present invention.

Example 7

A sprayable cleaning gel composition was made up at substantially standard temperature and pressure, in a suitable glass mixing vessel As each component was added, the mixture was stirred to promote intermixing. A list of the components may be found in Table 7, in the order of their addition to the mixture.

TABLE 7

| COMPONENT | AMOUNT (lbs) |
|---|---|
| FRAGRANCE[1] | 0.1 |
| ANTI-STATIC AGENT AND SURFACTANT[2] | 0.2 |
| DISPERSANT[3] | 0.1 |
| WATER | 96.20 |
| SOLVENT[4] | 3.0 |
| THICKENER[5] | 0.2 |
| SOLVENT[6] | 0.15 |
| BASE[7] | 0.05 |
| TOTAL | 100.0 |

Wherein the superscripts of Table 7. are defined as follows:
[1]0.1 lbs. of oil-based fragrance sold by the Aroma Tech Company of Somerville, N.J. as 'Fruity' No. 239575.
[2]A nonionic liquid silicone emulsion lubricant/softener sold by Eastern Color & Chemical Co. of Providence, RI as Eccolube RT-5-8.
[3]A solution of 75% water and 25% the sodium salt of a maleic acid-olefin copolymer, sold by BASF Corp. of Parsippany, N.J. as Sokalan CP-9.
[4]Propylene glycol t-butyl ether sold by Arco Chemical of Houston, TX as PTB.
[5]A cross-linked polyacrylic acid polymer sold by B.F Goodrich of Cleveland, OH as CARBOPOL EZ-1 in powder form. The mixture was then stirred until the CARBOPOL powder was uniformly dispersed.
[6]A glycol ether sold by Dow Chemical Co. of Midland, MI.
[7]A solution of 50% water and 50% NaOH, added last, by stirring which serves to raise the pH of the composition.

This sprayable cleaning gel composition, having a pH of 5.7, when placed into a manual pump spray applicator Model SSA manufactured by Calmar, Inc. having an orifice size of 0.025 inches in diameter, was found to be sprayable, cling in a non-running manner to the surface, and when wiped thereoff left the surface clean with virtually no static electric charge on the surface. The viscosity was measured to be 2,850 cP.

The sprayable cleaning gel composition of Table 7 was then subjected to spray/cling tests. The tests were conducted at substantially standard temperature and pressure as follows: the composition was sprayed once onto a vertical mirror 22 inches long by 18 inches wide from a distance of 4 inches using the aforesaid pump sprayer with an orifice of 0.025 inches. The following results were obtained:

| Run Distance | Elapsed Time |
|---|---|
| zero | not applicable |

Based upon the spray/cling tests, it was determined that the composition sprayed freely and the dwell time was ideal for the purpose of the present invention.

Example 8

A sprayable cleaning gel composition was made up at substantially standard temperature and pressure, in a suitable glass mixing vessel. As each component was added, the mixture was stirred to promote intermixing. A list of the components may be found in Table 8, in the order of their addition to the mixture.

TABLE 8

| COMPONENT | AMOUNT (lbs.) |
|---|---|
| FRAGRANCE[1] | 0.1 |
| ANTI-STATIC AGENT AND SURFACTANT[2] | 0.2 |
| DISPERSANT[3] | 0.1 |
| WATER | 95.58 |

TABLE 8-continued

| COMPONENT | AMOUNT (lbs.) |
|---|---|
| SOLVENT[4] | 3.0 |
| THICKENER[5] | 0.4 |
| SOLVENT[6] | 0.15 |
| BASE[7] | 0.47 |
| TOTAL | 100.0 |

Wherein the superscripts of Table 8. are defined as follows:
[1]0.1 lbs. of oil-based fragrance sold by the Aroma Tech Company of Somerville, N.J. as 'Fruity' No. 239575.
[2]A nonionic liquid silicone emulsion lubricant/softener sold by Eastern Color & Chemical Co. of Providence, RI as Eccolube RT-5-8.
[3]A solution of 75% water and 25% the sodium salt of a maleic acid-olefin copolymer, sold by BASF Corp. of Parsippany, N.J. as Sokalan CP-9.
[4]Propylene glycol t-butyl ether sold by Arco Chemical of Houston, TX as PTB.
[5]A cross-linked polyacrylic acid polymer sold by B.F Goodrich of Cleveland, OH as CARBOPOL EZ-1 in powder form. The mixture was then stirred until the CARBOPOL powder was uniformly dispersed.
[6]A glycol ether sold by Dow Chemical Co. of Midland, MI.
[7]A solution of 50% water and 50% NaOH, added last, by stirring which serves to raise the pH of the composition.

This sprayable cleaning gel composition, having a pH of 11.2, when placed into a manual pump spray applicator Model SSA manufactured by Calmar, Inc. having an orifice size of 0.025 inches in diameter, was found to be sprayable, cling in a non-running manner to the surface, and when wiped thereoff left the surface clean with virtually no static electric charge on the surface. The viscosity was measured to be 5,550 cP.

The sprayable cleaning gel composition of Table 8 was then subjected to spray/cling tests. The tests were conducted at substantially room temperature at 1 atmosphere as follows: the composition was sprayed once onto a vertical mirror 22 inches long by 18 inches wide from a distance of 4 inches using the aforesaid pump sprayer with an orifice of 0.025 inches. The following results were obtained:

| Run Distance | Elapsed Time |
|---|---|
| zero | not applicable |

Based upon the spray/cling tests, it was determined that the dwell time was ideal for the purpose of the present invention, however, the spray was on the verge of spraying globs rather than spraying finely.

Example 9

Take the ingredients listed in Table 9 and mix thoroughly in the order listed, with continuous stiring, at substantially standard temperature and pressure, in a glass container. This should yield a sprayable cleaning gel composition in accordance with the present invention.

TABLE 9

| COMPONENT | AMOUNT (lbs.) |
|---|---|
| WATER | 95.8 |
| ACETIC ACID | 2.0 |
| SURFACTANT[1] | 2.0 |

TABLE 9-continued

| COMPONENT | AMOUNT (lbs.) |
|---|---|
| THICKENER[2] | 0.2 |
| TOTAL | 100.0 |

[1]A surfactant sold by Tomah Products, Inc. of Milton, Wis. under the name "TOMAH AO-14-2".
[2]A cross-linked polyacrylic acid polymer sold by B.F Goodrich of Cleveland, OH as CARBOPOL EZ-1 in powder form. The mixture is then stirred until the CARBOPOL powder is uniformly dispersed.

Example 10

Take the ingredients listed in Table 10 and mix thoroughly in the order listed, with continuous stirring at substantially standard temperature and pressure, in a glass container. This should yield a sprayable cleaning gel composition in accordance with the present invention.

TABLE 10

| COMPONENT | AMOUNT (lbs.) |
|---|---|
| WATER | 84.7 |
| ISOPROPYL ALCOHOL | 15.0 |
| SURFACTANT[1] | 0.10 |
| THICKENER[2] | 0.2 |
| TOTAL | 100.00 |

[1]A surfactant sold by Shell Chemical Company under the name "NEODOL 23-6.5".
[2]A cross-linked polyacrylic acid polymer sold by B.F Goodrich of Cleveland, OH as CARBOPOL EZ-1 in powder form. The mixture is then stirred until the CARBOPOL powder is uniformly dispersed.

Example 11

Take the ingredients listed in Table 11 and mix thoroughly in the order listed, with continuous stirring at substantially standard temperature and pressure in a glass container. This should yield a sprayable cleaning gel composition in accordance with the present invention.

TABLE 11

| COMPONENT | AMOUNT (lbs.) |
|---|---|
| WATER | 95.8 |
| ISOPROPYL ALCOHOL | 3.7 |
| AMMONIA (CONCENTRATED) | 0.15 |
| SURFACTANT[1] | 0.15 |
| THICKENER[2] | 0.2 |
| TOTAL | 100.0 |

[1]A surfactant sold by the Shell Chemical Company under the name "NEODOL 25-3A".
[2]A cross-linked polyacrylic acid polymer sold by B.F Goodrich of Cleveland, OH as CARBOPOL EZ-1 in powder form. The mixture is then stirred until the CARBOPOL powder is uniformly dispersed.

Example 12

Take the ingredients listed in Table 12 and mix thoroughly in the order listed, with continuous stirring at substantially standard temperature and pressure, in a glass container. This should yield a sprayable cleaning gel composition in accordance with the present invention.

TABLE 12

| COMPONENT | AMOUNT (lbs.) |
|---|---|
| METHANOL | 48.8 |
| ISOPROPYL ALCOHOL | 48.0 |
| SURFACTANT[1] | 0.5 |
| THICKENER[2] | 0.2 |
| AMMONIUM HYDROXIDE | 2.5 |
| TOTAL | 100.00 |

[1]A surfactant sold by the Rohm and Haas company of Philadelphia, PA under the name "TRITON QS-30"
[2]A cross-linked polyacrylic acid polymer sold by B.F Goodrich of Cleveland, OH as CARBOPOL EZ-1 in powder form. The mixture is then stirred until the CARBOPOL powder is uniformly dispersed.

Example 13

Take the ingredients listed in Table 13 and mix thoroughly in the order listed, with continuous stirring at substantially standard temperature and pressure in a glass container. This should yield a sprayable cleaning gel composition in accordance with the present invention.

TABLE 13

| COMPONENT | AMOUNT (lbs.) |
|---|---|
| WATER | 93.4 |
| THICKENER[1] | 0.2 |
| SODIUM EDTA | 0.4 |
| SURFACTANT[2] | 4.0 |
| AMMONIA (CONCENTRATED) | 2.0 |
| TOTAL | 100.00 |

[1]A cross-linked polyacrylic acid polymer sold by B.F Goodrich of Cleveland, OH as CARBOPOL EZ-1 in powder form. The mixture is then stirred until the CARBOPOL powder is uniformly dispersed.
[2]The surfactant component of this example is a mixture of 1 lb. of Nonionic surfactant of the NP-6 type with 3 lb. of a surfactant sold by Tomah Products of Milton, WIS. under the name "TOMAH AO-14-12".

Example 7 is considered by Applicant to be the best mode for carrying out the invention.

It is to be understood that the acceptable range of the dwell time of the sprayable cleaning gel composition provides substantially motionless surface dwell, wherein after being sprayed upon a surface, the sprayable cleaning gel composition dwells thereupon as described with respect to Examples 2 through 8 hereinabove, preferably without any running, as a result of the viscosity thereof being within the preferred range of 900 cP to 5,5500 cP.

It is to be further understood that the term "substantially homogeneous" means herein a substantially homogeneous material on a macroscopic level, ie., on a scale detectable to a naked eye observer.

To those skilled in the art to which this invention pertains, the above described preferred embodiments and the above described examples may be subject to change or modification. Such change or modification can be carried out without departing from the scope of the invention, which is intended to be limited only by the scope of the appended claims.

What is claimed is:

1. A sprayable cleaning gel composition which is free of suspended encapsulated particles, consisting essentially of:
- from about 75% to about 98% by weight of a liquid carrier;
- from about 0.005% to about 20% by weight of a surfactant component comprising at least one surfactant selected from the group consisting of nonionic, anionic, cationic, amphoteric, and zwitterionic surfactants and mixtures thereof;
- from about 0.001% to about 5% by weight of a carboxylic acid copolymer dispersant;
- from about 0.01% to about 2% by weight of a high molecular weight powdered, crosslinked polyacrylic acid thickener;
- from about 1% to about 20% by weight of at least one supplemental solvent for dissolving oil-based particles in water, said at least one supplemental solvent being selected from the group consisting of:
  - ethylene glycol ethers; and
  - propylene glycol ethers; and
- from about 0.05% to about 1.0% by weight of a nonionic ester complex anti-static agent;
- wherein said sprayable cleaning gel composition has a gel consistency having a viscosity ranging from about 900 centipoise to about 5,500 centipoise.

2. The composition of claim 1, wherein said surfactant is a nonionic surfactant.

3. The composition of claim 1, wherein said surfactant is a nonionic water-soluble lubricant and softener which provides both surfactant and anti-static properties to the composition in a range from about 0.05% to about 1.0% of the composition.

4. The composition of claim 1, wherein said viscosity range is from about 1,500 centipoise to about 4,500 centipoise.

5. A packaged cleaning gel composition for cleaning surfaces, comprising:
- a sprayable cleaning gel composition which is free of suspended encapsulated particles, consisting essentially of:
  - from about 75% to about 98% by weight of a liquid carrier;
  - from about 0.005% to about 10% by weight of a surfactant component comprising at least one surfactant selected from the group consisting of nonionic, anionic, cationic, amphoteric, and zwitterionic surfactants and mixtures of the above;
  - from about 0.001% to about 5% by weight of a carboxylic acid copolymer dispersant;
  - from about 0.01% to about 2% by weight of a high molecular weight powdered, crosslinked polyacrylic acid thickener;
  - from about 1% to about 20% by weight of at least one supplemental solvent for dissolving oil-based particles in water, said supplemental solvent selected from the group consisting of:
    - ethylene glycol ethers; and
    - propylene glycol ethers; and
    - from about 0.05% to about 1.0% by weight of a nonionic ester complex anti-static agent;
  - wherein said sprayable cleaning gel composition has a gel consistency having viscosity ranging from about 900 centipoise to about 5,500 centipoise; and
- a spray applicator comprising:
  - a container having a reservoir for holding said sprayable cleaning gel composition therewithin;
  - a spray head movably connected with said container, said spray head having an orifice therein, said reservoir being in fluid communication with said spray head and said orifice when said spray head is selectively moved in relation to said container, and
  - means for propelling said sprayable cleaning gel composition sprayably through said orifice responsively to said selective movement of said spray head.

6. The packaged cleaning gel composition of claim 5, wherein said orifice in said spray head has a diameter range from about 0.010 to about 0.040 inch.

7. The packaged cleaning gel composition of claim 6, wherein said surfactant is a nonionic water-soluble lubricant and softener which provides both surfactant and anti-static properties to the composition in a range from about 0.05% to about 1.0% of the composition.

8. A method for cleaning a surface, comprising the steps of:

spraying a sprayable cleaning gel composition which is free of suspended encapsulated particles, consisting essentially of:

from about 75% to about 98% by weight of a liquid carrier;

from about 0.005% to about 20% by weight of a surfactant component comprising at least one surfactant selected from the group consisting of nonionic, anionic, cationic, amphoteric, and zwitterionic surfactants and mixtures thereof;

from about 0.001% to about 5% by weight of a carboxylic acid copolymer dispersant;

from about 0.01% to about 2% by weight of a high molecular weight powdered, crosslinked polyacrylic acid thickener;

from about 1% to about 20% by weight of at least one supplemental solvent for dissolving oil-based particles in water, said at least one supplemental solvent being selected from the group sonsisting of:

ethylene glycol ethers; and propylene glycol ethers; and from about 0.05% to about 1.0% by weight of a nonionic ester complex anti-static agent; having a viscosity from about 900 centipoise to about 5,550 centipoise onto a surface to be cleaned, wherein said sprayable cleaning gel composition clings to and dwells on said surface rather than running downwardly thereon due to gravity at standard temperature and pressure;

spreading said sprayable cleaning gel composition selectively around said surface with a wiping article; and wiping said sprayable cleaning gel composition off said surface via the wiping article to thereby clean the surface.

9. The method of claim 8, wherein said step of wiping reduces static electricity on the surface. which is free of suspended encapsulated particles, consisting essentially of:

from about 75% to about 98% by weight of a liquid carrier;

from about 0.005% to about 20% by weight of a surfactant component comprising at least one surfactant selected from the group consisting of nonionic, anionic, cationic, amphoteric, and zwitterionic surfactants and mixtures thereof;

from about 0.001% to about 5% by weight of a carboxylic acid copolymer dispersant;

from about 0.01% to about 2% by weight of a high molecular weight powdered, crosslinked polyacrylic acid thickener;

from about 1% to about 20% by weight of at least one supplemental solvent for dissolving oil-based particles in water, said at least one supplemental solvent being selected from the group consisting of:

ethylene glycol ethers; and propylene glycol ethers; and from about 0.05 to about 1.0% by weight of a nonionic ester complex anti-static agent.

* * * * *